US009010658B2

(12) United States Patent
Johnson et al.

(10) Patent No.: US 9,010,658 B2
(45) Date of Patent: Apr. 21, 2015

(54) AIRLESS SPRAY TIP

(75) Inventors: Daniel R. Johnson, Blaine, MN (US); Charles W. Dawson, Big Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 20 days.

(21) Appl. No.: 13/521,696

(22) PCT Filed: Jan. 26, 2011

(86) PCT No.: PCT/US2011/022488

§ 371 (c)(1), (2), (4) Date: Jul. 11, 2012

(87) PCT Pub. No.: WO2011/094246

PCT Pub. Date: Aug. 4, 2011

(65) Prior Publication Data

US 2012/0298771 A1 Nov. 29, 2012

Related U.S. Application Data

(60) Provisional application No. 61/298,775, filed on Jan. 27, 2010.

(51) Int. Cl.

| | |
|---|---|
| ***B05B 15/00*** | (2006.01) |
| ***B05B 15/02*** | (2006.01) |
| ***B05B 15/06*** | (2006.01) |
| *B05B 1/30* | (2006.01) |
| *B05B 9/01* | (2006.01) |

(52) U.S. Cl.

CPC ..... *B05B 15/0283* (2013.01); *B05B 15/02* (2013.01); *B05B 15/001* (2013.01); *B05B 1/3046* (2013.01); *B05B 9/01* (2013.01); *B05B 15/065* (2013.01)

(58) Field of Classification Search

CPC .... B05B 15/001; B05B 15/02; B05B 15/0283
USPC ..... 239/119
See application file for complete search history.

(56) References Cited

U.S. PATENT DOCUMENTS 5,699,967 A * 12/1997 Conatser et al. ..... 239/526

FOREIGN PATENT DOCUMENTS

| | | |
|---|---|---|
| DE | 19757240 A1 | 8/1998 |
| JP | 62079865 A | 4/1987 |

OTHER PUBLICATIONS

Graco Inc. RACX Solvent Seal Instruction Manual revision dated Jul. 2004.
Graco Inc. RACX HandTite Guard Instruction Manual revision dated Oct. 2002.

* cited by examiner

*Primary Examiner* — Ryan Reis
(74) *Attorney, Agent, or Firm* — Kinney & Lange, P.A.

(57) ABSTRACT

In airless spray tip assembly 100 shown in FIG. 2, cylinder 112 contains tip 114 and is at one end of dead zone 116. Shutoff 118 is comprised of ball 120 and seat 122. The needle seat 122 has been mated to each tip assembly 100 (See FIG. 2). By mating the tip 114 and the seat assembly (shutoff) 118 into one, the seal 124 can be moved out of the 'dead zone' 116 thus reducing spit volume and energy storage.

5 Claims, 2 Drawing Sheets

AIRLESS SPRAY TIP

This application claims the benefit of U.S. application Ser. No. 61/298,775, filed on Jan. 27, 2010 the contents of which are hereby incorporated by reference.

TECHNICAL FIELD

Background Art

Typical airless spray tips are shown in U.S. Pat. Nos. 4,165,836 and 6,702,198, the contents of which are incorporated by reference. In current reversible spray tip applications; it is commonplace to have potential energy stored in o-rings that lie ahead of the mechanical fluid seal that actuates the gun and behind the spray tip. Examples of high potential energy storing materials would be o-rings. They store energy in such a way that when the gun is shutoff, the seals de-energize and spit onto the painter's work.

DISCLOSURE OF THE INVENTION

It is an object of this invention is to minimize energy storage in an airless spray tip to minimize spit volume. The construction of this tip assembly is different than prior art devices. The needle seat has been mated to each tip assembly. By mating the tip and the seat assembly into one, the seal can be moved out of the 'dead zone' thus reducing spit volume. The instant invention eliminates all o-rings ahead of the mechanical fluid shutoff, thus minimizing the spit.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
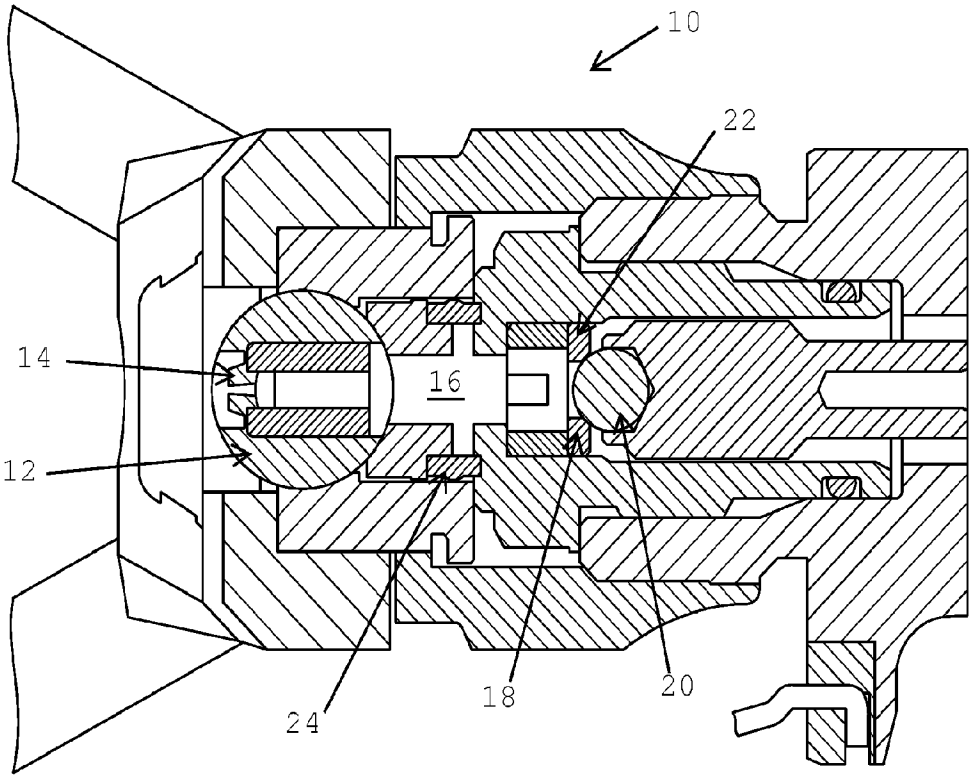
FIG. 1 PRIOR ART
FIG. 1 shows a prior art tip assembly.

In the prior art reversible tip assemblies 10 such as shown in FIG. 1, cylinder 12 contains a spray tip 14 of a known design. A dead zone 16 is located between tip 14 and the shutoff 18 comprised of ball 20 and seat 22. An o-ring seal 24 is located in the dead zone 16 and can store energy and release same. Seal 24 is compressible when exposed to typical airless spraying pressures, typically 2000-3000 psi. While any material is theoretically compressible, as used herein, the term denotes materials which can be substantially compressed and released when exposed to such pressures. Metals and similar materials in their normal form are not considered compressible.

Figure 2:
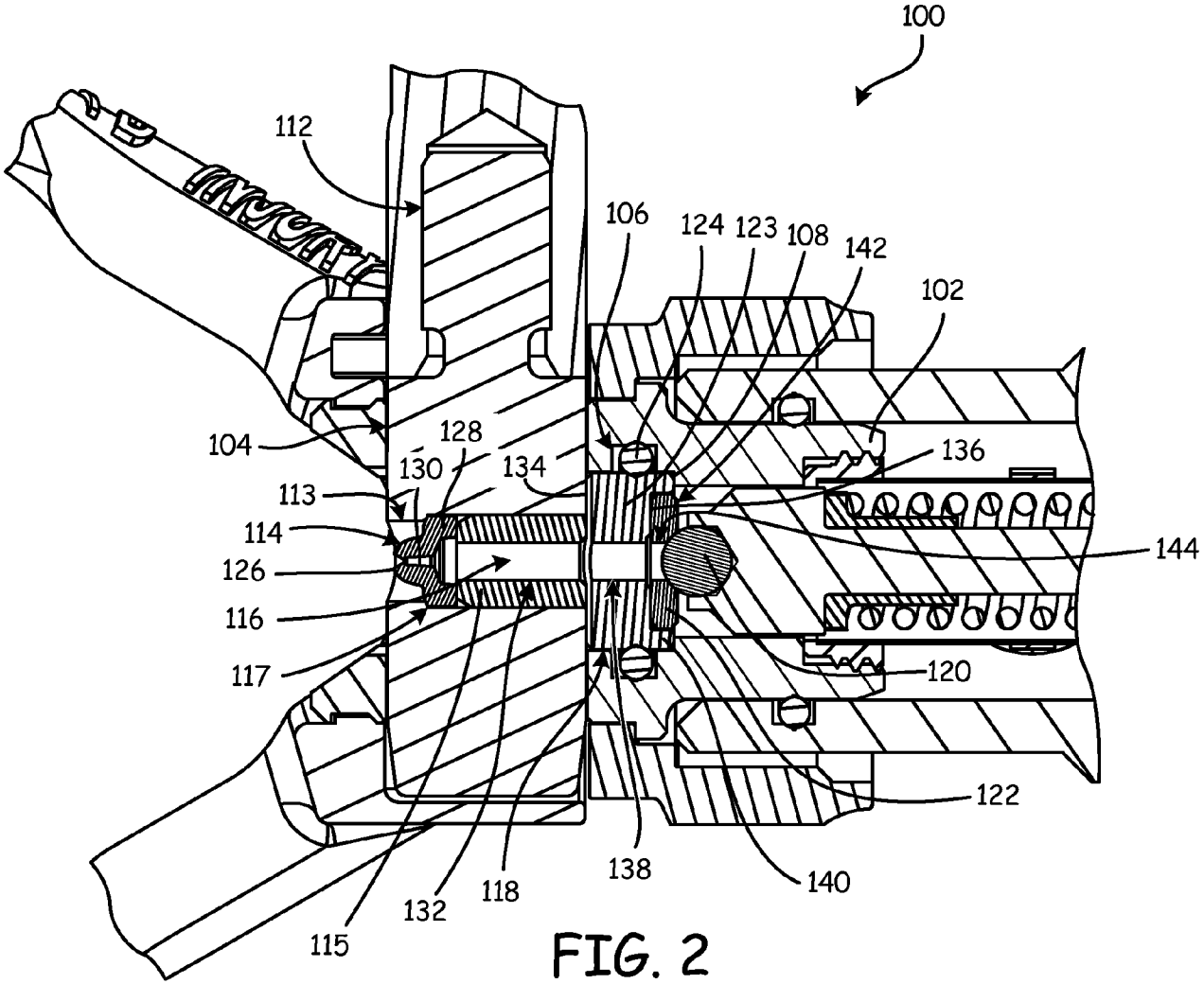
FIG. 2 shows the tip assembly of the instant invention.

In FIG. 2, tip assembly 100 includes cap 102 and rotatable cylinder 112. Cap 102 includes radial bore 104, annular groove 106, and shoulder 108. In the instant invention tip assembly 100 shown in FIG. 2, cylinder 112 includes first axial bore 113. Cylinder further contains spray tip 114 and sleeve 115, and cylinder 112 is at one end of dead zone 116. Cylinder 112 further includes shoulder 117 projecting into first axial bore 113. Shutoff 118 is comprised of ball 120 seat 122, and seat support 123. The seat 122 has been mated to each tip assembly 100 (See FIG. 2). Spray tip 114 includes tip 126, annular projection 128, and spray orifice 130. Spray orifice 130 projects through spray tip 114 from annular projection 128 to tip 126. Sleeve 115 includes second axial bore 132 therethrough. Seat support 123 includes upstream end 134, downstream end 136 and third axial bore 138. Flange 140 projects from upstream end 134 and defines annular recess 142 at upstream end 134 of seat support 123. Seat 122 includes fourth axial bore 144. Dead zone 116 includes second axial bore 132, third axial bore 142, and fourth axial bore 144. By mating the tip 114 and the seat assembly (shutoff) 118 into one, the seal 124 can be moved out of the 'dead zone' 116 thus reducing spit volume and energy storage.

Rotatable cylinder 112 is disposed within first radial bore 104 of cap 102. Spray tip 114 is disposed within first axial bore 113 with tip 126 facing upstream. Spray tip 114 is retained within first axial bore by annular projection 128 engaging shoulder 117. Sleeve 115 is similarly disposed within first axial bore 113 adjacent to and upstream of spray tip 114. Second axial bore 132 is aligned with spray orifice 130. Seat support 123 is disposed within cap 102. Downstream end 136 of seat support 123 is located adjacent rotatable cylinder 112 and sleeve 115. A free end of flange 140 abuts shoulder 108 to retain upstream end 134 of seat support 123. Seat 122 is disposed within annular recess 142 of seat support 123. Third axial bore 138 and fourth axial bore 144 are aligned to define a flowpath through shutoff 118. Third axial bore 138 and fourth axial bore 144 are also aligned with second axial bore 132, which is aligned with spray orifice 130 to define dead zone 116. Seal 124 is located radially outward of seat support 123 and contained within annular groove 106 of cap 102.

In current reversible spray tip applications; it is commonplace to have potential energy stored in o-rings that lie ahead of the mechanical fluid seal that actuates the gun and behind the spray tip. Examples of high potential energy storing materials would be o-rings. They store energy in such a way that when the gun is shutoff, the seals de-energize and spit onto the painter's work. The instant invention eliminates all o-rings ahead of the mechanical fluid shutoff, thus minimizing the spit.

It is contemplated that various changes and modifications may be made to the spray tip without departing from the spirit and scope of the invention as defined by the following claims.

The invention claimed is:

1. A reversible airless spray tip assembly comprising:

a cap having a first radial bore;

a rotatable cylinder disposed within the first radial bore, the rotatable cylinder having a first axial bore therethrough and a shoulder projecting into the first axial bore;

a spray tip having a tip, an annular projection, and a spray orifice, the spray tip disposed within the first axial bore with the annular projection abutting the shoulder;

a sleeve having a second axial bore therethrough, the sleeve disposed within the first axial bore upstream of and abutting the spray tip, with the second axial bore aligned with the spray orifice;

a shutoff mechanism disposed within the cap upstream of the rotatable cylinder, the shutoff mechanism comprising:

a seat support having an upstream end, a downstream end, a third axial bore therethrough, and an annular flange projecting from the upstream end to define an annular recess at the upstream end of the seat support, the downstream end adjacent to the rotatable cylinder and the sleeve;

a seat having a fourth axial bore therethrough, the seat disposed within the annular recess of the first seat; and a ball attached to an actuating mechanism, the ball engaging the seat when the reversible airless spray tip is shut off, and the ball disengaged from the seat when the reversible spray tip is turned on;

a dead zone defined by the second axial bore, the third axial bore, and the fourth axial bore; and wherein compressible materials are eliminated from the dead zone such that spitting of fluid from the dead zone is minimized when the reversible airless spray tip is shut off.

2. The reversible airless spray tip assembly of claim 1, wherein an annular seal is disposed radially outward of the seat support and secured between the seat support and the cap.

3. The reversible airless spray tip assembly of claim 2, wherein the cap includes an annular groove, and the annular seal is disposed within the annular groove.

4. The reversible airless spray tip assembly of claim 1, wherein a diameter of the seat support is greater than a diameter of the sleeve.

5. The reversible airless spray tip assembly of claim 1, wherein the cap includes a second shoulder, the flange abutting the second shoulder to secure the seat support between the cap and the rotatable cylinder.

* * * * *